US006695053B2

(12) United States Patent
Stewart

(10) Patent No.: US 6,695,053 B2
(45) Date of Patent: Feb. 24, 2004

(54) BAILER DISCHARGING DEVICE AND METHOD OF USING THEREOF

(75) Inventor: Shawn Stewart, Houston, TX (US)

(73) Assignee: ESP Environmental Service Products, Inc., Cocoa, FL (US)

( * ) Notice: Subject to any disclaimer, the term of this patent is extended or adjusted under 35 U.S.C. 154(b) by 0 days.

(21) Appl. No.: 10/157,754

(22) Filed: May 29, 2002

(65) Prior Publication Data

US 2003/0221826 A1 Dec. 4, 2003

(51) Int. Cl.[7] ..... E21B 49/08

(52) U.S. Cl. ..... 166/264; 166/108; 166/162; 166/168

(58) Field of Search ..... 166/244.1, 250.01, 166/250.03, 264, 108, 162, 168; 73/864.63

(56) References Cited

U.S. PATENT DOCUMENTS 2,214,350 A * 9/1940 Santiago
2,217,147 A * 10/1940 Vesely
2,220,989 A * 11/1940 Brauer
4,491,178 A * 1/1985 Terrell et al.
4,823,623 A * 4/1989 Carpenter et al.
5,878,813 A * 3/1999 Ridgeway
6,276,220 B1 * 8/2001 Varhol

* cited by examiner

*Primary Examiner*—Roger Schoeppel
(74) *Attorney, Agent, or Firm*—William B. Ritchie

(57) ABSTRACT

An apparatus for discharging sample fluid from a bailer with a ball-joint and a method of using thereof. The apparatus has a body, an interior and an exterior, a top opening and a bottom opening, and a lip disposed around the top opening. The bottom of the apparatus has a bailer-support disposed across the diameter of the bottom opening. A pin is located at the center of the bailer-support.

The apparatus functions as a bailer discharge device. The apparatus is designed to be placed into an opening of a bucket or drum and is adapted to discharge sample fluid from the base of a bailer into a bucket or drum when the bailer with a ball-joint is inserted through the top opening of the apparatus and rests on the pin attached to the bailer-support support. The pin acts to release the ball-joint thereby allowing the sample fluid to be discharged into the bucket or drum.

6 Claims, 5 Drawing Sheets

BAILER DISCHARGING DEVICE AND METHOD OF USING THEREOF

FIELD OF THE INVENTION

This invention relates to the field of fluid sampling, and, in particular, to an apparatus for discharging fluid from a bailer and method of using thereof.

BACKGROUND OF THE INVENTION

Modern industries produce contaminants which are often released onto land. The contaminants migrate downward into the subsurface creating potential health risks. Subsequently, contaminant remediation plans are implemented to remove ground water contamination.

Designing a remediation plan typically requires collecting fluid samples to determine the extent of subsurface contamination. The term fluid as used herein refers to both gas and liquid. Fluid samples are analyzed to determine contaminant concentration, organic chemistry in the case of soil gas, and both organic and inorganic chemistry in the case of liquid.

During many environmental investigations, groundwater is collected from groundwater monitoring wells for laboratory analysis of waters, existing at subsurface levels. Groundwater collection is currently accomplished by use of a bailer, as described in U.S. Pat. No. 5,979,569 by Heller. The '569 patent discloses a sampling device having a fluid collecting portion adapted to recover a fluid sample from a subsurface. Fluid entering the fluid collecting portion passes through a valve which may be remotely actuated. After the sampling device has been driven into the subsurface and a fluid sample has been collected in the fluid collecting portion, the valve is closed to prevent cross-contamination of the fluid sample in the fluid collecting portion.

Although the '569 apparatus has improved upon the bailer device used to collect fluid samples in that it minimizes cross-contamination of the fluid sample in the fluid collecting portion, the '569 apparatus still has many drawbacks. First, in order to accomplish groundwater collections, a field technician collects water from a monitoring well by submerging the bailer into the monitoring well bore down to the water table. The technician holds onto the bailer by gripping a rope or string. The bailer is designed to collect water when submerged and thereafter hold the water when raised by the technician through a ball-joint type apparatus in the bailer. The technician proceeds with multiple rounds of water collection to purge a monitoring well pursuant to required evacuation volumes ("purging"). Thereafter, the technician collects water samples in the bailer for laboratory analysis ("sampling").

However, when the technician raises the bailer above the surface, the technician must carefully position the bailer top to an opening in a bucket-type or drum-like receptacle and pour the liquid collected in the bailer into the bucket or drum. These bucket and drum openings are typically screw top openings and small in diameter. As a result, the technician must be extremely careful not to spill any of the collected groundwater. Additionally, the technician must be careful not to cause any potential cross-contamination of the collected water with any other material, which may result from the string, rope, or bailer touching any surface. Errors during this process could destroy the integrity of the groundwater sample.

Second, this process of groundwater collection is associated with repetitive bending and excessive motion, which can cause back and other ergonomic injuries to technicians. A technician, on any given day in the field, may repeat the process of sampling and emptying a bailer for hours. The technician must necessarily undertake many cumbersome and repetitive motions including, for example, bending at the waist to position the bailer correctly. The technician will have to repeatedly turn and twist and engage in varying body motions to accomplish the task. The repetitive and related body motions over time lead to fatigue, error, and inefficiency.

Thirdly, because of the requirement that the technician pour the sample from the bailer into a collection bucket, the length of the bailor is limited. Modifying the '569 patent to contain a longer bailer would not be possible because the pouring would be impermissible if the bailer were longer. If the '569 bailer were longer, the technician would run a greater risk of spilling groundwater by over-pouring because the technician would be required to turn the bailer toward the bucket opening while facing greater distances from the bucket, faster discharge velocities, and increased overall awkwardness of the required body motions. Therefore, as a result of the limited length of the bailer, the '569 apparatus increases the total purging time by increasing the number of purging events.

Finally, the current apparatus and procedure results in water leaking from the bottom of the bailer. This occurs because the bailer must be turned upside down to pour the contents of the bailer into the bucket or drum. As the technician turns the bailer upside down, the ball-joint rolls forward. This produces leakage. In addition to the mess and loss of sample, this leaking also increases the total purging time by increasing the number of purging events, and as a result, reduces the efficiency of groundwater collection projects.

Therefore, what is needed is a device that would aid in discharging a bailer apparatus that eliminates the back and other ergonomic injuries to technicians that they would otherwise experience from the excessive and repetitive motions, that increases efficiency, reduces time per sampling or purging events, eliminates principal causes of potential cross contamination, eliminates repositioning of hands in maneuvering the rope holding the bailer, and overall cuts down on fatigue and error.

SUMMARY OF THE INVENTION

The bailer discharging device includes a body with an interior and an exterior, and a top opening and a bottom opening, where the top opening has a lip disposed around the top opening. The apparatus also has a bailer-support disposed across the diameter of the bottom opening, with the bailer-support having a center and a pin perpendicularly attached to the center, and the pin vertically extending in the interior, towards the top opening.

The method of collecting a fluid sample from a bailer with a ball-joint includes the first step of providing a bailer discharge device followed by a second step of inserting the bailer discharge device into an opening of a bucket used for collecting said fluid sample. The third step consists of placing the bottom of the bailer holding the fluid sample into the bailer discharge device to a resting position, whereby the bailer mates with the pin. The fourth step is releasing the ball joint, followed by the final step of collecting the fluid sample from the bailer in the bucket.

Therefore, it is an aspect of this invention to provide a bailer discharging device and a method of using thereof that aids in eliminating the back and other ergonomic injuries to technicians that they would otherwise experience from the excessive and repetitive motions associated with fluid sampling.

It is another aspect of the present invention to increase the efficiency of fluid sampling.

It is a further aspect of the present invention to reduces the time per sampling or purging event associated with fluid sampling.

It is another aspect of the present invention to eliminate the principal causes of potential cross contamination associated with fluid sampling.

It is another aspect of the present invention to eliminate repositioning of hands in maneuvering the rope holding the bailer when performing fluid sampling.

It is another aspect of the present invention to cut down on the overall fatigue and error associated with performing fluid sampling.

These aspects of the invention are not meant to be exclusive and other features, aspects, and advantages of the present invention will be readily apparent to those of ordinary skill in the art when read in conjunction with the appended claims and accompanying drawings.

DETAILED DESCRIPTION OF THE INVENTION

Figure 1:
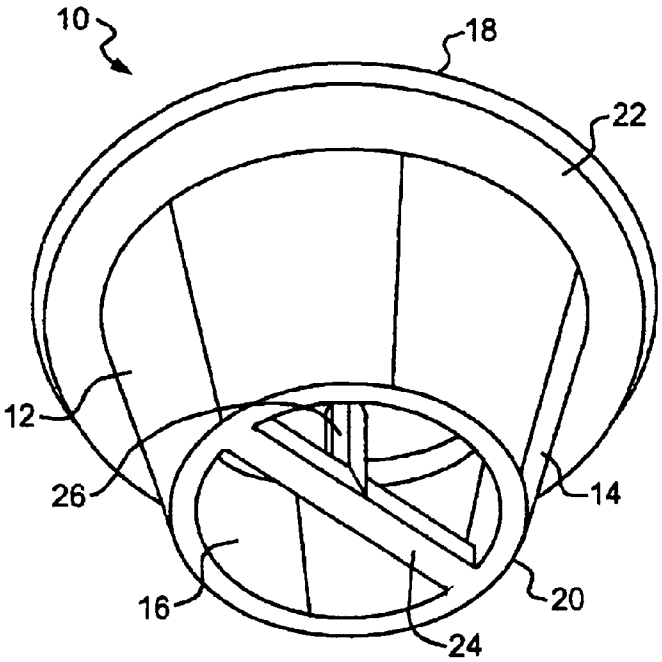
FIG. 1 is a side-view of the bailer discharge device.

Referring first to FIG. 1, the preferred embodiment of the bailer discharge device is shown. The bailer discharge device 10 consists of a body 12, having an exterior 14 and an interior 16. In the preferred embodiment, the bailer discharge device 10 is conical in shape and has a tapering diameter. But, in alternate embodiments, the bailer discharge device 10 is any shape known to those of ordinary skill in the art, including square, circular, rectangular or triangular. The bailer discharge device 10, in its preferred embodiment, is made of plastic by the process of injection molding and is preformed of a single piece of plastic. In other embodiments, the bailer-support 24 and pin 26 are preformed separately from the bailer discharging device 10. Although the bailer discharge device in the preferred embodiment is made of plastic, in other embodiments, the bailer discharge device 10 is made of any metal such as stainless steel, titanium, aluminum, copper, nickel, iron or other metals commonly used by those of ordinary skill in the art. In still other embodiments, the bailer discharge device 10 is made of other natural or synthetic solid materials, such as rubber, PVC or other polymers, wood, glass, teflon or cement. Located at the top 18 of the bailer discharge device 10 is a lip 22. The lip extends around the entire circumference of the top 18 of the bailer discharge device 10. In the preferred embodiment of the invention, the top 18 of the bailer discharge device 10 has a diameter larger than the bottom 20 of the bailer discharge device 20.

Still referring to FIG. 1, the bottom 20 of the bailer discharge device 10 has a bailer-support 24 extending across the diameter of the bottom 20. In the center of the bailer-support 24 is a pin 26. In the preferred embodiment, the bailer-support 24 and pin 26 are made of the same material as the body 12 of the bailer discharge device 10. But, in other embodiments, the bailer-support 24 and pin 26 are made of different materials from the bailer discharge device 10.

Figure 2:
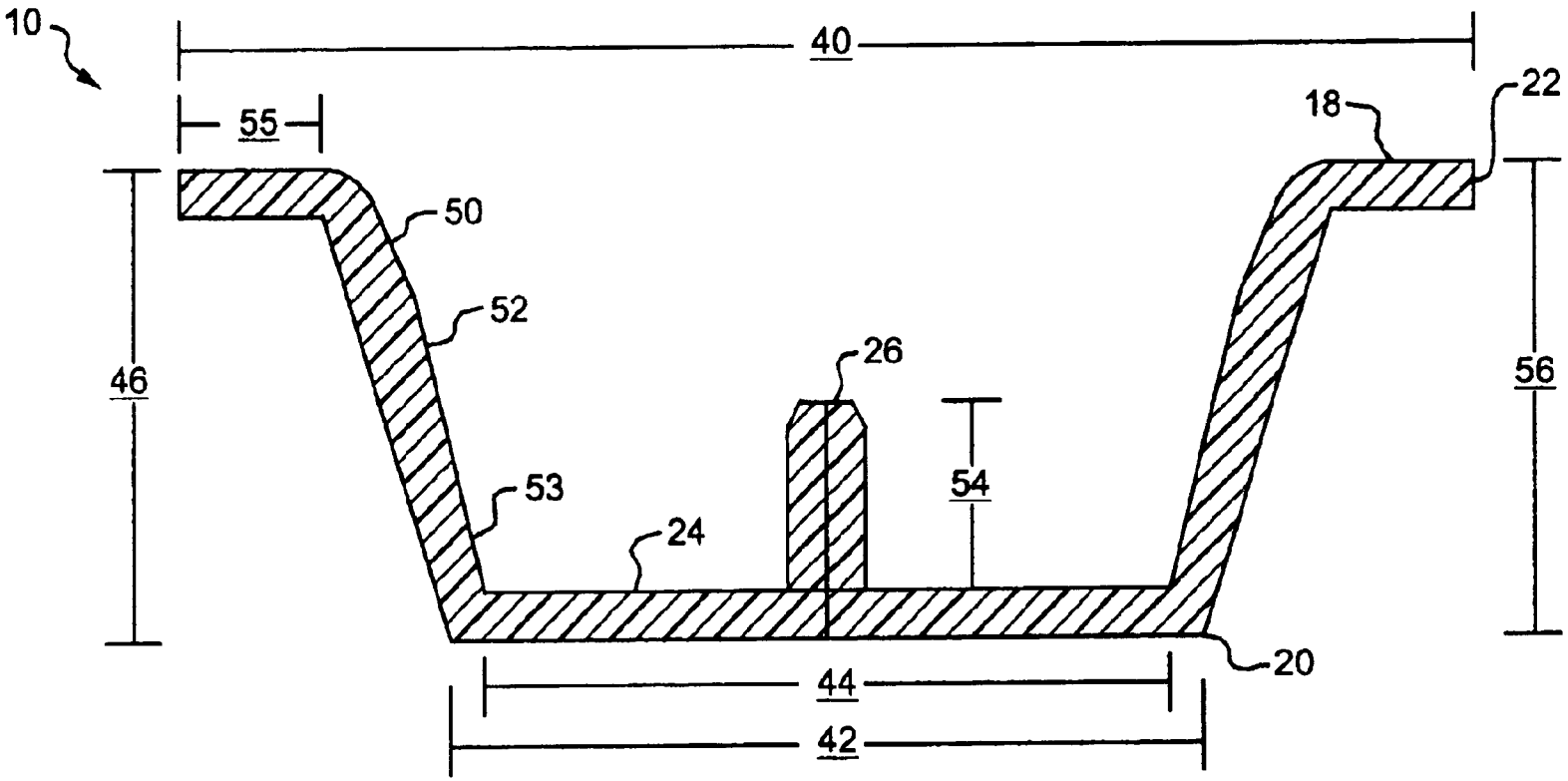
FIG. 2 is a cross-sectional schematic view of the bailer discharge device dimensions.

Referring next to FIG. 2, the preferred embodiment of the bailer discharge device 10 is shown in a schematic view. The bailer discharging device 10 dimension 40 is approximately 1.7 inches, and dimension 46 is approximately 1 inch. The dimension 40 corresponds to the opening of the bailer discharge device 10. Dimension 56 is approximately 1 inch and the bailor discharging device 10 tapers from the top 18, to the bottom 20 starting at an angle 50 which is approximately 30° to an angle 52 of approximately 15° to a final angle 53 of approximately 18 degrees. The bottom dimension 42 is approximately 1.7 inches, while the diameter 44 of the bottom 20 of the bailer discharging device 10 is approximately 1.5 inches. The bailer-support 24 has dimensions equal to the diameter 44 of the bailer discharging device 10 which is approximately 1.5 inches. The lip 22 has a dimension 55 of approximately 0.5 wide. In other embodiments, the lip 22 has any dimension greater than 0. The dimension 56 from the bottom 20 to the lip 22 is approximately 1.2 inches. The pin 26 stands on the bailer-support 24 at a height 54 of approximately 0.7 inches. Depending on the shape of the bailer discharge device 10, other embodiments will have different dimensions.

Figure 3:
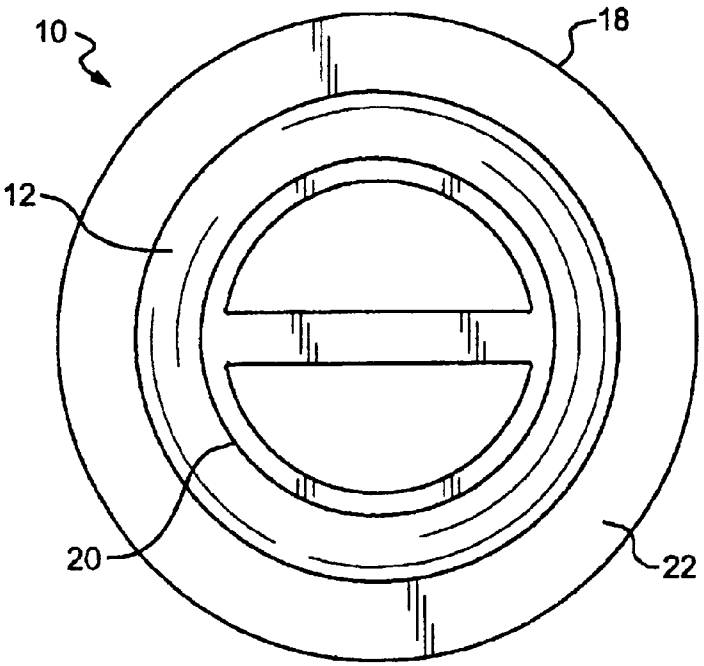
FIG. 3 is a bottom view of the bailer discharge device
Figure 4:
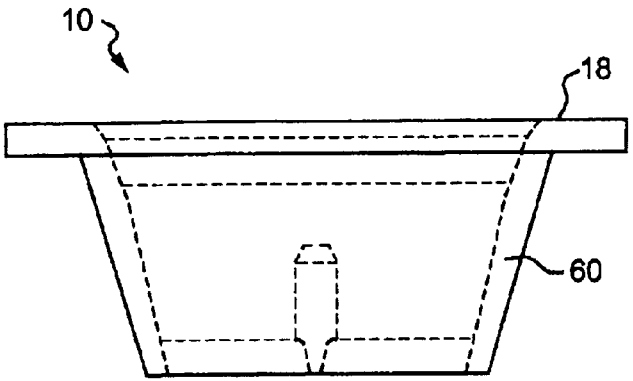
FIG. 4 is a cross-sectional view of the bailer discharge device with hidden lines indicating wall thickness.

Referring next to FIG. 3 which shows the bottom view of the bailer discharge device 10. As shown in FIG. 3, the bottom 20 has a diameter significantly smaller than the top 18 and the lip 22 extends from the top 18 of the body 12. Referring now to FIG. 4, a cross-sectional view of the bailer discharge device 10 is shown. The invisible lines indicate the wall thickness 60 of the bailer discharge device 10. The bailer discharge device 10 in its preferred embodiment has a wall thickness 60 of approximately 0.1 inches. In other embodiments, the wall thickness 60 can be any value as long as the interior 16 is large enough for a bailer to be inserted.

Although the preferred embodiment of the bailer discharge device 10 has been described in terms of dimensions, the bailer discharge device 10 dimensions, in alternative embodiments, are extremely varied. Depending on the shape of the bailer discharge device 10 the other dimensions will vary accordingly. Additionally, by changing the diameter and angles of the bailer discharge device 10, the bailer discharge device 10 could be used on any size bailer. For example, a 48 inch commercial well needs to be bailed with a 36 inch bailer lifted by crane and then emptied. Thus, the bailer discharge device 10 can be used with a 36 inch bailer provided the dimensions are enlarged, and the angles are varied to fit the container and bailer. Therefore, any or all angles, even if you reverse the angle outward, are alternative embodiments of the bailer discharge device 10. The dimensions and shape of the bailer discharge device 10 will vary depending on the dimensions and shapes of the bailers to be used in conjunction with the bailer discharge device 10. Since the pin 26 is the element of the bailer discharge device 10 that actually discharges the bailer, all bailer discharge device 10 shapes and dimensions that allow for the mating of a particular bailer with the pin 26 are envisioned alternate embodiments of this invention.

Figure 7:
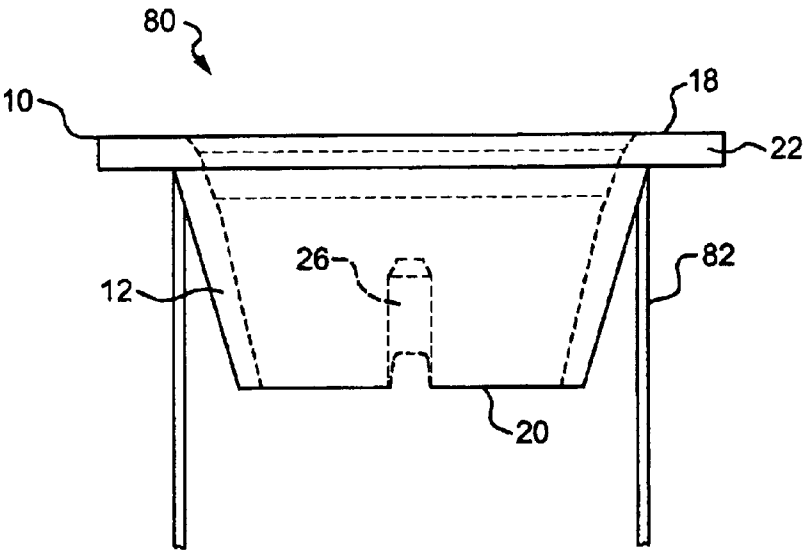
FIG. 7 is a cross-sectional view of the bailer discharging device in conjunction with a bucket or drum.
Figure 5:
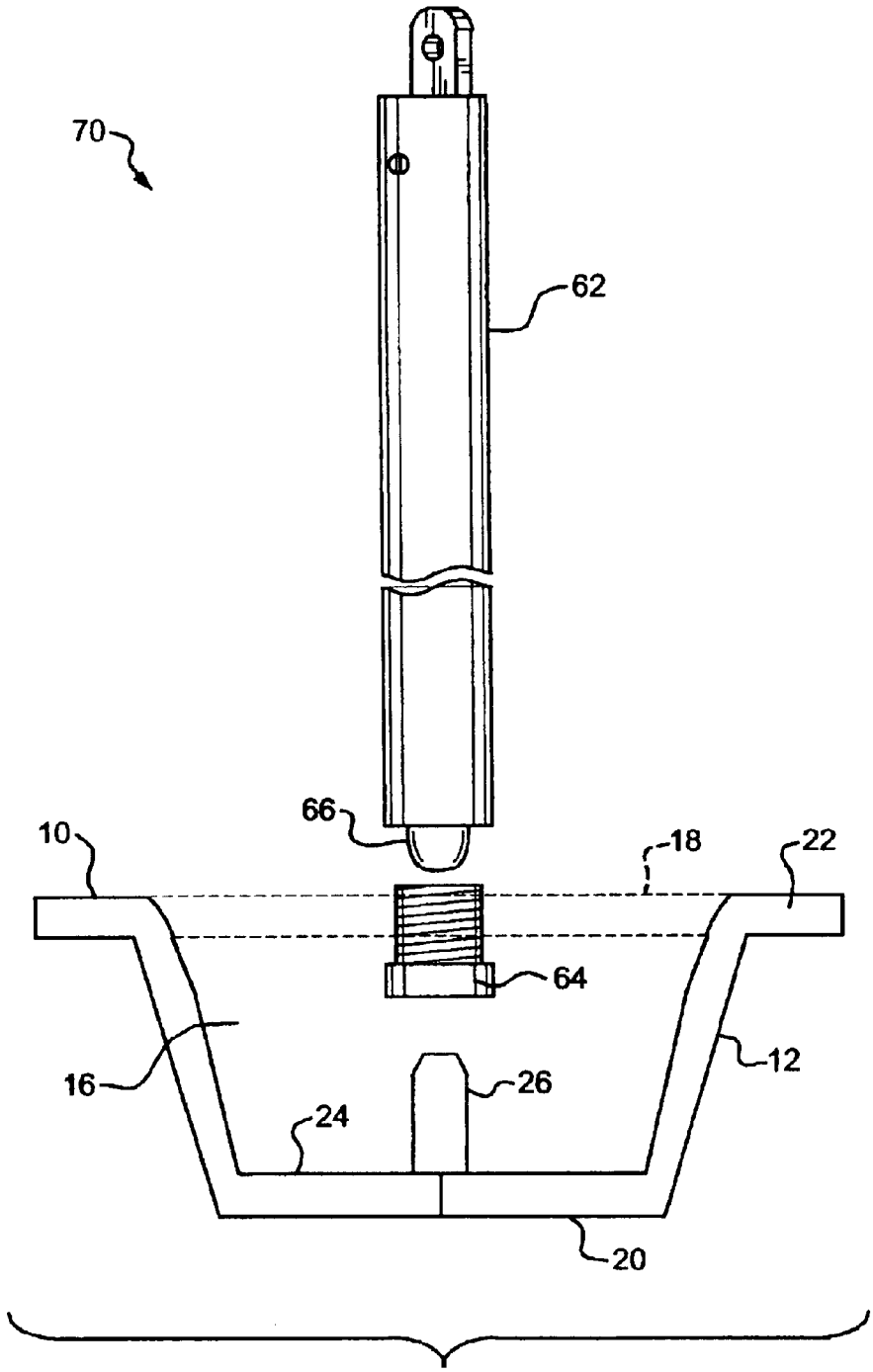
FIG. 5 is a view of the bailer discharging device and a bailer.
Figure 6:
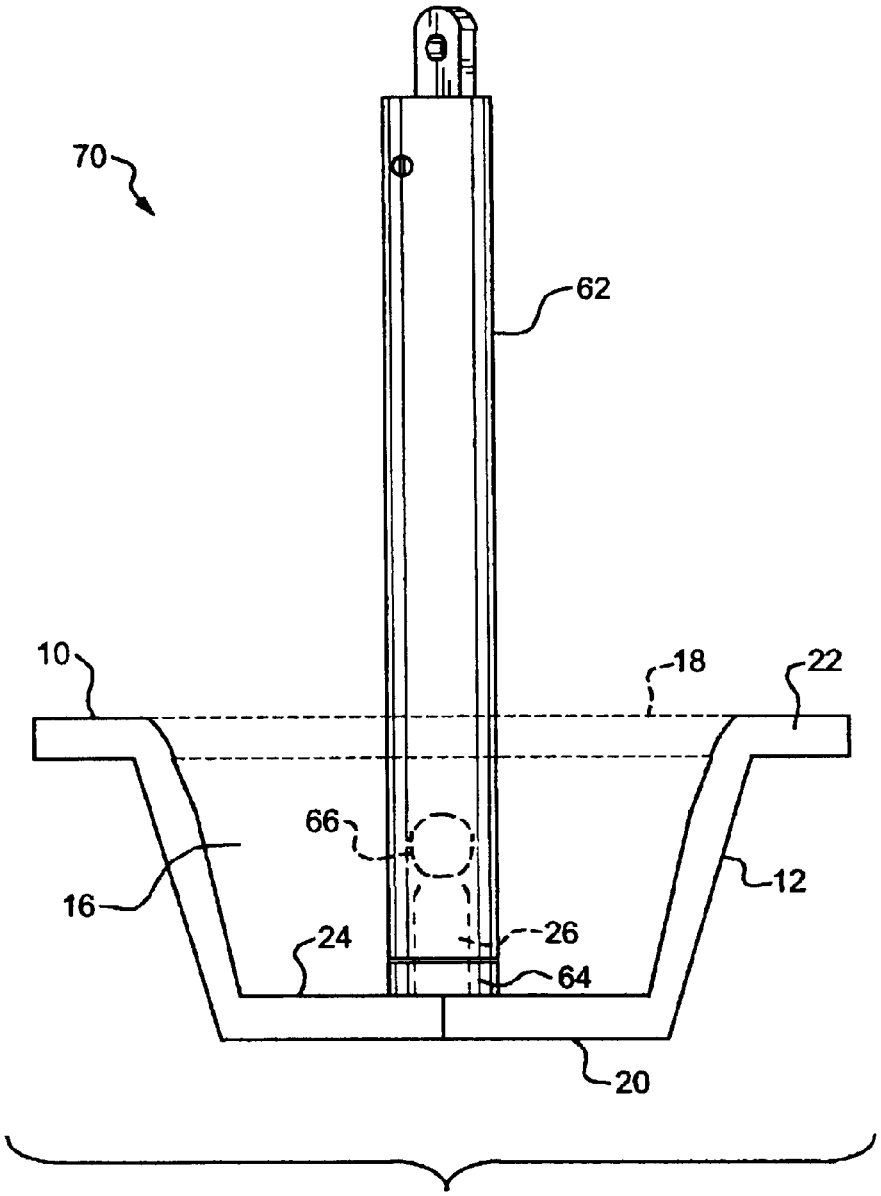
FIG. 6 is a view of the bailer discharging device connected to a bailer.

In practice the bailer discharge device functions as shown in FIGS. 5, 6 and 7. The procedure in detail begins first with referring to FIG. 7. The bailer discharge device 10, is placed into a bucket or drum 82. The tapering diameter, working in conjunction with the lip 22 allows for the bailer discharge device 10 to function as an insert meant to be placed into the opening of a sample collection bucket or drum 82. The lip 22 rests upon the bucket or drum 82, and the body 12 goes inside the bucket or drum 82. This eliminates the possibility of spilling the sample, or contaminating the sample, for the sample located inside the bailer is directly discharged into the bailer discharging device 10, and from there, the sample is discharged into the bucket or drum 82.

Referring now to FIG. 5, the assembling of the unit 70 is shown in progress. The unit 70 is composed of a bailer 62 and a bailer discharging device 10. To form the unit 70 the bailer is placed onto the bailer discharge device 10. The discharge device 10 mating with the bailer 62, creates a unit 70 comprised of a bailer 62 and a bailer discharging device 10. The bailer 62 is designed to collect and hold fluid through a ball-joint 66 type apparatus in the bailer. The bailer 62, which has been submerged into a monitoring well, or else filled with a fluid sample, requires discharging, in order to collect the contained sample.

Still referring to FIG. 5, the bottom of the bailer 64 mates with the pin 26 of the bailer discharge device 10. The pin 26 of the bailer discharge device 10 acts to dislodge the ball from the ball-joint 66 allowing the fluid sample from the bailer to discharge directly from the bottom of the bailer 64 into the bucket or drum (not shown) without any pouring, cross-contamination, or excess body movement.

Referring next to FIG. 6, the completely assembled unit 70 is shown. The bottom 64 of the bailer 62 is mated with the pin 26 of the bailer discharging device 10. Invisible lines indicate the pin 26, which is currently inside the bailer 62, displacing and dislodging the ball-joint 66, also shown with invisible lines. This allows the fluid sample to discharge from inside the bailer 62, through the bottom 20 of the bailer discharging device 10, and into the bucket or drum 82 (shown in FIG. 7).

Referring back to FIG. 1, in the preferred embodiment, the bailer-support 24 extending through the diameter of the bottom 20 of the bailer discharging device 10, functions to hold the pin 26. The width of the bailer-support 24 is approximately 0.2, which equates to the base of the pin 26. This design enables the fluid sample to flow easy from the bailer to the bucket or drum. Referring again to FIG. 6, in addition, the bailer-support 24 provides a support for the bottom 64 of the bailer 62 to rest. The sample fluid flows through the bottom 20 of the bailer discharging device 10. In other embodiments, the bottom 20 of the bailer discharging device is not completely opened in the area surrounding the bailer-support, but consists of a plate that allows fluid to flow through. In other embodiments, this plate is disposable and removable, so as to prevent contamination. In these embodiments, the plate is made of either the same material as the bailer discharge device 10 or else of a different type of material. By varying both the width of the bailer-support 24 in the preferred embodiment, and the difference plates in the alternative embodiment, the bailer discharge device 10 can be adapted for use with any sized bailer 62, and with any type of sample.

Using the present invention as described above addresses the current problems in the art. First, the present invention eliminates any kind of potential cross-contamination of the collected sample fluid with any other material. Second, the present invention eliminates the bending and excessive motions, thereby lowering the risk of ergonomic injuries. Thirdly, the bailer discharging device also increases efficiency, reduces time per sampling or purging event, and eliminates repositioning of hands in maneuvering the rope holding the bailer, and overall cuts down on fatigue and error.

Additionally, the present invention, because it permits the technician to empty groundwater from a vertical position, adds the opportunity for a technician to use longer bailers that would have otherwise been unusable if pouring was required. Longer bailers can reduce the total purging time by reducing the number of purging events. More liquid volume can be collected with longer bailers. The technician simply positions the bottom of the bailer and the liquid is discharged. In contrast, when a technician uses a long bailer without the present invention, the technician runs a greater risk of spilling sample fluid by over-pouring because the technician must turn the bailer toward the bucket or drum opening while facing greater distances from the bucket, fast discharge velocities, and increased overall awkwardness of the required body motions.

The present invention is useful in groundwater sampling from monitoring wells, and other environmental subsurface investigations. In addition, other applications of the present invention would include emptying various liquids from bailer type instruments used in other industries. For example, in the dairy industry, the present invention would improve the discharge of milk collected in bailers from vats during product sampling at many depths. Other industries where the bailer discharge device 10 can be used is the petroleum industry, the beer industry, the soda industry, or the chemical industry.

Although the present invention has been described with reference to certain preferred embodiments thereof, other versions are readily apparent to those of ordinary skill in the art. Therefore, the spirit and scope of the appended claims should not be limited to the description of the preferred embodiments contained herein.

What is claimed is:

1. An apparatus for discharging fluid from a bailer having a ball-joint, said apparatus comprising:

a body having an interior and an exterior, a top opening and a bottom opening, said top opening having a lip disposed around said top opening and said bottom opening having a diameter; and a bailer-support disposed across said diameter of said bottom opening, said bailer-support being rigidly connected to said body and having a center, and a pin perpendicularly attached to said center, said pin vertically extending towards said top opening, whereby said bailer rests on said bailer-support and said pin mates with said bailer and releases said ball-joint, allowing said fluid to discharge from said bailer.

2. The apparatus claimed in claim 1, wherein said body is conical in shape.

3. The apparatus claimed in claim 1, wherein said body is cylindrical in shape.

4. The apparatus claimed in claim 1, wherein said body is plastic.

5. The apparatus claimed in claim 1, wherein said body is metal.

6. The apparatus claimed in claim 1, wherein said body is wood.

* * * * *